United States Patent [19]

Santostasi

[11] 4,300,701

[45] Nov. 17, 1981

[54] CLOSURE CAP

[75] Inventor: Paul Santostasi, Sarasota, Fla.

[73] Assignee: Sun Coast Plastic Closures, Inc., Sarasota, Fla.

[21] Appl. No.: 141,173

[22] Filed: Apr. 17, 1980

[51] Int. Cl.[3] ..... B65D 41/04

[52] U.S. Cl. ..... 220/289; 215/318

[58] Field of Search ..... 220/281, 284, 288, 289; 215/318, 329

[56] References Cited

U.S. PATENT DOCUMENTS 3,532,249 5/1969 Gach ..... 220/284

3,841,514 10/1974 Montgomery et al. ..... 215/329 X

*Primary Examiner*—George T. Hall

*Attorney, Agent, or Firm*—Arthur W. Fisher, III

[57] ABSTRACT

A closure cap for capping a fluid container comprising a top having a substantially annular skirt depending downwardly from the periphery thereof and a resilient interference structure formed on the inner surface of the substantially annular skirt to engage threads formed on the fluid container to form a locking seal therebetween.

2 Claims, 3 Drawing Figures

FIG. 1
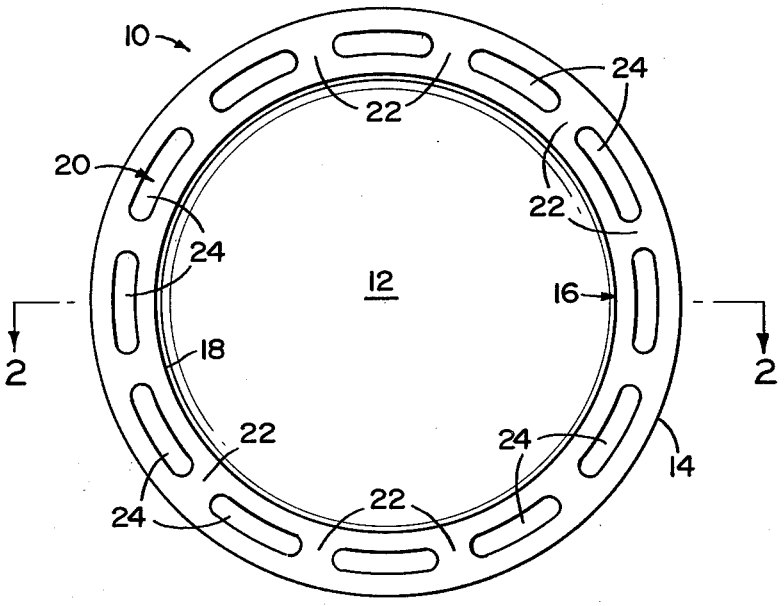
FIG. 2
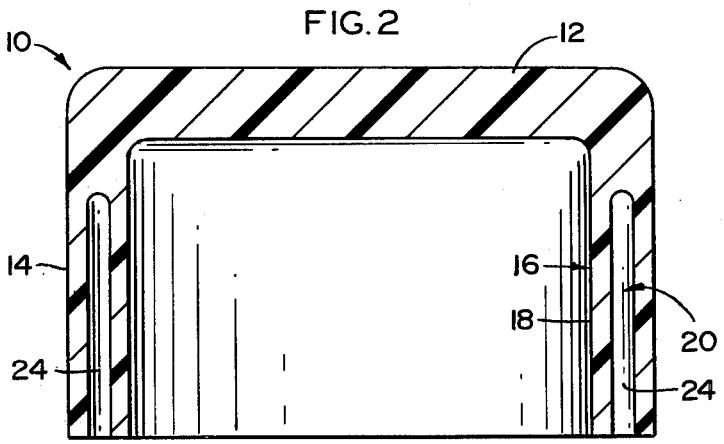
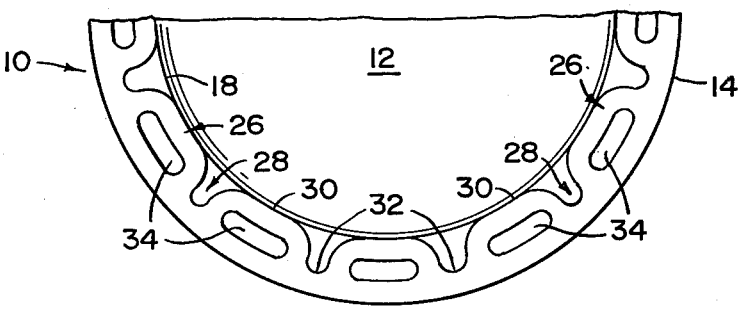
FIG. 3

CLOSURE CAP

BACKGROUND OF THE INVENTION

1. Field of the Invention

A closure cap including a resilient interference structure to form a locking seal with a fluid container.

2. Description of the Prior Art

Numerous efforts have been made to employ either metal or plastic closures. These efforts have included roll-on aluminum caps and plastic twist-off caps. Unfortunately such caps exhibit various drawbacks including ineffective re-sealing and relatively expensive production costs. Typical of these efforts is found in U.S. Pat. No. 3,648,874.

SUMMARY OF THE INVENTION

The present invention relates to a closure cap for capping a fluid container. The closure cap comprises a top having a substantially annular skirt depending downwardly from the periphery thereof and a resilient interference structure formed on the inner surface of the substantially annular skirt.

The resilient interference structure comprises a concentric inner wall in parallel spaced relationship relative to the substantially annular skirt. The resiliency of the inner wall and the provision of the void or chamber permits the threads to exert outward pressure against the inner wall permitting the inner wall to conform to the shape of the threads thereby forming a locking seal therebetween.

A plurality of ribs may be formed in spaced relationship within the chamber forming a plurality of voids or chambers concentrically disposed relative to the substantially annular skirt and inner wall.

In use the cap and any of its embodiments as previously described is placed upon a fluid container either pressed fitted or threaded on. The resiliency of the interference structure permits the inner wall or surfaces to operatively engage the threads and form a locking seal therebetween.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a bottom view of the closure cap.

FIG. 2 is a cross sectional view of the closure cap taken along lines 2—2 of FIG. 1.

FIG. 3 is a bottom view of an alternative embodiment of the closure cap.

Similar reference characters refer to similar parts throughout the several views of the drawings.

DETAILED DESCRIPTION OF THE PREFERRED EMBODIMENT

As shown in FIGS. 1 and 2 the present invention relates to a closure cap generally indicated as 10 for capping a fluid or dry container. The closure cap 10 comprises a top 12 having a substantially annular skirt 14 depending downwardly from the periphery thereof and a resilient interference structure 16 formed on the inner surface of the substantially annular skirt 14 and depending downwardly from the top 12 disposed to engage threads formed on the fluid container (not shown) to form a locking seal therebetween.

As shown in FIG. 2 the resilient interference structure 16 comprises a concentric inner wall 18 in parallel spaced relationship relative to the substantially annular skirt 14 to form a void or chamber 20 therebetween. As described more fully hereinafter the resiliency of the inner wall 18 and the provision of the void or chamber 20 permits the threads to exert outward pressure against the inner wall 18 permitting the inner wall 18 to conform to the shape of the threads thereby forming a locking seal therebetween.

As shown in FIG. 1 a plurality of ribs 22 may be formed in spaced relationship within the chamber 20 forming a plurality of voids or chambers 24 concentrically disposed relative to the substantially annular skirt 14 and inner wall 18. These ribs 22 in combination with the void is 24 enhance the locking properties of the resilient interference structure 16.

Alternately as shown in FIG. 3, the concentric inner wall 18 may be interrupted forming a plurality of ridges and flutes 26 and 28 respectively. The inner surface of the individual ridges 30 cooperatively form a concentric circle relative to the substantially annular skirt 14 while the inner surfaces of the flutes 32 similarly form a concentric relative to the substantially annular skirt 14. As previously described the individual ridges 26 may each include a correspondingly void or chamber 32 to enhance the locking properties of the resilient interference structure 16 when operatively engaging the threads of the fluid container. Although discussion has referred to a fluid container, dry containers for use with powder or soap are equally useful.

In use the cap and any of its embodiments as previously described is placed upon a fluid container either pressed fitted or threaded on. The resiliency of the interference structure 16 permits the inner wall 18 or surfaces 26 to operatively engage the threads and form a locking seal therebetween.

It will thus be seen that the objects set forth above, and those made apparent from the preceding description are efficiently attained and since certain changes may be made in above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described, what is claimed is:

1. A closure cap for capping a container including a threaded neck, said closure cap comprising a top having substantially annular skirt depending downwardly therefrom, a resilient interference structure comprising a concentrical inner wall in parallel spaced relationship relative to said substantially annular skirt forming a chamber therebetween and a plurality of ribs formed between said substantially annular skirt and said concentric inner wall to form a plurality of interrupted chambers therebetween, such that said concentric inner wall engages the threads formed on the container to deform said concentric inner wall adjacent said interrupted chambers to form a locking seal therebetween whereby said closure cap is a press fit to the container.

2. A closure cap for capping a container comprising a top having a substantially annular skirt depending downwardly from the periphery thereof and having a plurality of spaced ridges and flutes interruptedly formed about a substantially resilient interference structure wherein each of said ribs includes a chamber formed therein such that said ribs engage threads formed on the container to form a locking seal therebetween.

* * * * *